US010380977B1

(12) United States Patent
Rose

(10) Patent No.: US 10,380,977 B1
(45) Date of Patent: Aug. 13, 2019

(54) TREMOLO ADJUSTMENT APPARATUS

(71) Applicant: Floyd D. Rose, Del Mar, CA (US)

(72) Inventor: Floyd D. Rose, Del Mar, CA (US)

( * ) Notice: Subject to any disclaimer, the term of this patent is extended or adjusted under 35 U.S.C. 154(b) by 0 days.

(21) Appl. No.: 16/139,610

(22) Filed: Sep. 24, 2018

(51) Int. Cl.
*G10D 3/14* (2006.01)

(52) U.S. Cl.
CPC ..... *G10D 3/146* (2013.01)

(58) Field of Classification Search
CPC ..... G10D 3/146; G10D 3/00
See application file for complete search history.

(56) References Cited

U.S. PATENT DOCUMENTS

| | | | | |
|---|---|---|---|---|
| 4,171,661 | A | 10/1979 | Rose | |
| 6,198,036 | B1 * | 3/2001 | Hoshino | G10H 3/185 84/313 |
| 9,818,382 | B2 | 11/2017 | Rose | |
| 2005/0076767 | A1 * | 4/2005 | McCabe | G10D 3/146 84/313 |

OTHER PUBLICATIONS

"The almost perfect drop-in fit for vintage tremolos", Coherent Sound in Light, CSL-Sophia.com, 2016, pp. 1-4.

Global Tuners, Stabilizers and Tuning Systems Setup Guide, SOPHIA Ultimate Tremolo, 2018, pp. 1-7.

New Schaller Sure Claw Spring Tensioner Spring Tension Adjuster Strat Tremolo, The STRATosphere, online article, 2018, https://stratosphereparts.com/new-schaller-sure-claw-spring-tensioner-spring-tension-adjuster-strat-tremolo/.

Schaller Sure claw Tremolo String Tensioner, Upgrade your Floyd Rose, Fender etc., Reverb.com, 2018, online article, http://reverb.com/item/7748562-schaller-sure-claw-tremolo-string-tensioner-upgrade-your-floyd-rose-fender-etc.

* cited by examiner

*Primary Examiner* — Kimberly R Lockett
(74) *Attorney, Agent, or Firm* — Lerner, David, Littenberg, Krumholz & Mentlik, LLP

(57) ABSTRACT

A float angle adjustment apparatus for use with a stringed musical instrument including a lower block, attachable within the instrument, and an upper block. The lower block includes top, bottom, front, side, and rear surfaces, and a lower tailpiece extending outwardly from the lower block. The upper block includes top, bottom, front, side, and rear surfaces, and an upper tailpiece extending outwardly from the upper block. The upper tailpiece is spaced apart from the lower tailpiece. The upper block is pivotally attached to the lower block such that moving the upper and lower tailpieces relative to one another, such as via an adjustable screw, pivots the upper block relative to the lower block and, in turn, adjusts a float angle of a baseplate attachable to the top of the upper block.

20 Claims, 5 Drawing Sheets

TREMOLO ADJUSTMENT APPARATUS

BACKGROUND OF THE INVENTION

The present invention relates generally to stringed musical instruments and, more particularly, to an adjustment apparatus for adjusting the bridge or baseplate float angle of a floating tremolo mounted to a stringed musical instrument.

Strings of a musical instrument, such as a guitar, extend lengthwise along the neck and are supported above the neck between two contact points, typically between the nut located at the head of the instrument, and the saddle element of the bridge located at the base of the instrument. Each of the strings also typically extends beyond the contact points, including past the nut at the head end, where each string is secured to a tuning peg for adjusting the tension of the string, and past the saddle at the bridge end, where each string extends beyond the saddle contact point and is anchored to the instrument.

The sound produced by each of the strings is affected both by the string length (e.g., the length of the string between the two contact points) and by the tension of the string. On certain stringed instruments such as an electric guitar, string length is typically adjusted by adjusting the distance between the contact points at which the string contacts the saddles of the bridge and the nut. This is generally referred to as harmonic or string length tuning. The tension of the strings is also generally adjusted by adjusting the tuning pegs, or finer adjustments made at the bridge by some guitar tremolo systems, which serve to increase or decrease the tension of the strings. This adjustment is referred to as pitch or fine tuning of the strings. Typically, each one of the strings may be tuned (both harmonic and pitch) independently from the other strings of the musical instrument.

The action of the strings, or the height of the strings above the fretboard, is another parameter that can usually be adjusted to the desires of an individual player who may prefer that the stings sit closer to, or farther from, the fretboard for playability purposes. Bridges thus can be adjustable to hold the strings at a settable height above the fingerboard of the instrument.

Tremolo devices are used for significantly reducing or increasing the tension of all of the strings of the musical instrument simultaneously, thereby producing unusual tone variations or special sound effects. Although the effects achievable with tremolo devices on guitars and the like were popularized in the 1960's, early tremolo devices were not readily adopted because they frequently caused the strings to go out of tune. However, in the late 1970's and early 1980's, tremolos were embraced by both rock stars and casual players as a result of several inventions by Floyd Rose, the named inventor herein, because such Floyd Rose tremolos alleviated the problems associated with the strings being detuned during tremolo use.

In U.S. Pat. No. 4,171,661 (hereinafter "the '661 Patent"), Rose's original tremolo patent, the disclosure of which is incorporated by reference herein, the bridge of the musical instrument is provided on a floating tremolo device and the strings are held or "locked" at or in the vicinity of both the bridge and the nut of the instrument so as to be restrained against relative sliding movement during activation and return of the tremolo device. In this manner, after the tremolo is used and then returned to an inactive position, the strings return to the same tension as before activation and, therefore, remain in tune. The bridge also cantilevers or floats between an upwards and downward bending position during use of the tremolo system and should return to a steady-state position or float angle set for the desired string action.

A guitarist or guitar technician may, nevertheless, need to adjust the bridge float angle in a floating tremolo system. The bridge float angle can change over time based on play, wear, change of string gauge, loss of tremolo spring tension, and other factors. The bridge float angle is typically set to be parallel with a top surface of the guitar body.

In order to adjust the bridge float angle of the tremolo device such as is disclosed in the '661 Patent, the user must adjust the tension of the springs that hold the floating tremolo in its neutral position and allow the tremolo to change angles during use. To do so, the adjustor must first gain access to the springs, which are disposed within the guitar body and accessed through a cavity in the rear surface of the guitar body.

The tremolo springs are usually anchored to the guitar body via an anchoring plate that is fastened to the underside cavity by a pair of anchoring screws. This cavity is ordinarily covered by a protective cover plate that is fastened into rear surface of the guitar body by a number of cover plate screws. As a result, adjusting the bridge float angle can be time-consuming and difficult since it takes time and effort to remove all of the cover plate screws, make the bridge angle adjustment, and then replace the cover plate screws. Further, there are typically three or more tremolo springs attached to the anchoring plate and care must be exercised in adjusting each of the two anchoring screws so that the tension on all of the springs remains constant. Still further effort is required to make the adjustments from the bottom of the guitar, and then flip over the guitar to check the new float angle, and if not quite correct, the guitar must be flipped over again, adjusted, re-flipped over and checked again. This adjust, flip over, and re-adjust process can be time-consuming and frustrating.

BRIEF SUMMARY OF THE INVENTION

In accordance with a first aspect of the present invention, a stringed musical instrument assembly is provided that includes a stringed musical instrument, a floating tremolo, and a float angle adjustment apparatus. The stringed musical instrument includes a body having a top surface and a bottom surface. The tremolo is coupled to the instrument body and includes a pivotal baseplate having a float angle relative to the upper surface of the instrument body. The adjustment apparatus includes a first support block extending from an underside of the baseplate and at least partially into the instrument body below the top surface a second support block connected to the first support block and coupled to the guitar body by a spring mechanism. The first support block includes a first member extending outwardly therefrom and the second support block includes a second member extending outwardly therefrom. Adjustment of a distance between the first member and the second member pivots the first support block about the second support block and, in turn, pivots the base plate relative to the guitar body to adjust the float angle of the baseplate.

In an exemplary embodiment, the stringed musical instrument is a guitar, for example, an electric guitar. The adjustment apparatus may further include a screw coupling the first member and the second member. The screw may be a hex screw. A head of the hex screw may be positioned adjacent a top surface of the first member.

The assembly may further include a hex key for adjusting the hex screw. Rotation of the screw in a first direction, for example, may move the first member toward the second member. On the other hand, rotation of the screw in a second direction opposite the first direction may move the first member away from the second member.

A portion of the first member may be angled in a downward direction relative to the top surface of the instrument body and portion of the second member may be angled in a downward direction relative to the top surface of the instrument body. The screw may be coupled between the downwardly angled portions of the first and second members such that the screw is accessible through an opening in the upper surface of the guitar body. In some instance, the angled portion of the first member may be substantially parallel with the angled portion of the second member when the float angle of the baseplate is parallel to the top surface of the instrument body.

In another embodiment, a floating tremolo device and a float angle adjustment apparatus is provided. The tremolo includes a baseplate. The float angle adjustment apparatus is coupled to the baseplate for adjusting a float angle of the baseplate relative to a surface of a stringed musical instrument. The adjustment apparatus includes a first support block extending from an underside of the baseplate and a second support block pivotally connected to the first support block. First and second members extend outwardly from the first and second support blocks, respectively. A screw may couple the first member and the second member such that rotation of the screw causes the first member to move relative to the second member and pivot the first support block about the second support block and, in turn, pivot the baseplate to adjust the float angle of the baseplate.

Rotation of the screw in a first direction may move the first member toward the second member and rotation of the screw in a second direction, opposite the first direction, may move the first member away from the second member. The screw may be a hex screw.

In another embodiment, a float angle adjustment apparatus for a floating tremolo is provided. The adjustment apparatus includes a lower block, an upper block, and an adjustable screw. The lower block is attachable by a spring mechanism to a body of a stringed musical instrument and includes top, bottom, front, side, and rear surfaces, and a lower tailpiece extending rearwardly from the lower block. The upper block includes top, bottom, front, side, and rear surfaces, and an upper tailpiece extending rearwardly from the upper block. The upper tailpiece is spaced apart from the lower tailpiece. The adjustable screw coupled the upper and lower tailpieces to one another such that rotation of the screw causes the top surface of the upper block to pivot relative to the top surface of the lower block.

The screw may be a set screw such that rotation of the set screw in a first direction moves the upper and lower tailpieces towards one another and rotation of the set screw in a second direction, opposite the first direction, moves the upper and lower tailpiece away from one another.

A portion of the upper tailpiece may be angled in a downward direction relative to the top surface of the upper block and a portion of the lower tailpiece may be angled in the downward direction relative to the top surface of the upper block. A set screw may extend between the downwardly angled portions of the upper and lower tailpieces coupling the upper and lower tail pieces to one another. The head of the set screw may be positioned adjacent a top surface of the upper tailpiece.

The upper block may include a notch for receiving a portion of the lower block and a pivot pin may extend through the upper block and the portion of the lower block received by the upper block. The lower block may include one or more apertures configured to receive one or more springs for coupling the adjustable tremolo to the stringed instrument.

DETAILED DESCRIPTION

Figure 1:
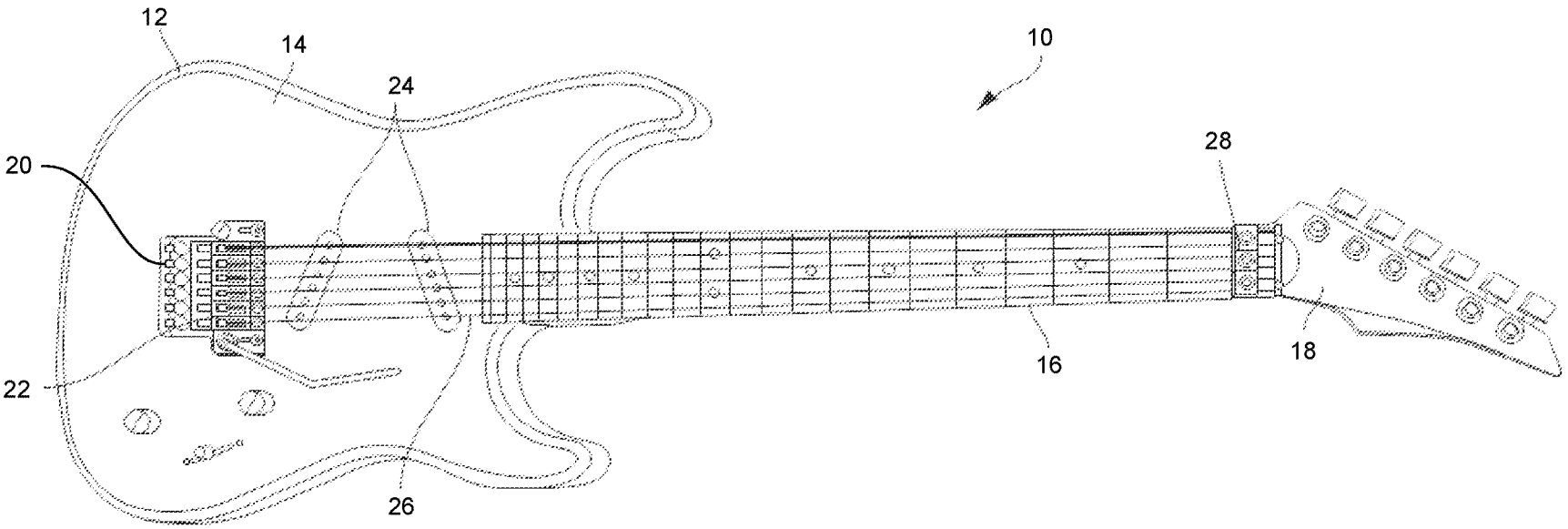
FIG. 1 PRIOR ART
FIG. 1 is a perspective view of an electric guitar including a known tremolo.

A typical electric guitar 10, an example of which is shown in FIG. 1, includes a body 12 having a generally flat top surface 14, a neck 16 having a base end connected to the body, and a headstock 18 provided on a top end of the neck opposite the base end. Neck 16 is often secured to body 12 by fastening the neck within a neck pocket (not shown) defined in the body. Alternatively, neck 16 may be integrally formed with guitar body 12.

Electric guitar 10 includes a floating tremolo 20 mounted to and within the guitar body, for example, a Floyd Rose tremolo as disclosed in the '661 Patent. Bridge 22 is positioned on tremolo 20 and coupled to the top surface 14 of guitar body 12. One or more pickups 24 are also mounted on the top surface 14 of body 12. Strings 26 are secured between bridge 22 and a nut 28, located adjacent to headstock 18, such that picking the strings will cause the strings to vibrate and produce corresponding musical notes when open or notes are fretted on the neck.

Figure 2:
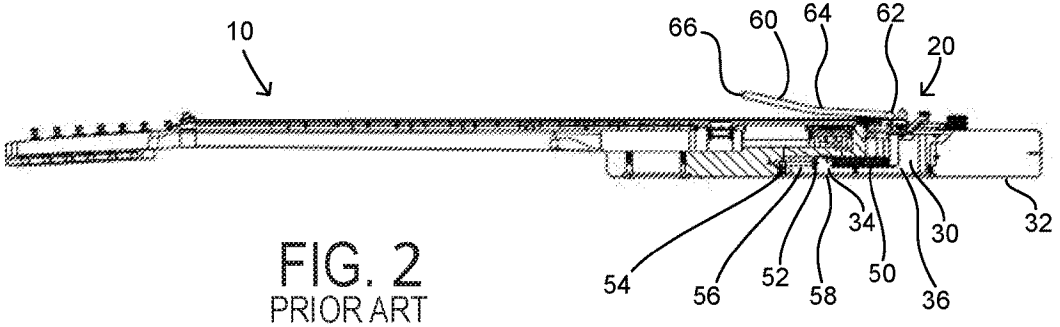
FIG. 2 PRIOR ART
FIG. 2 is a cross-section view of FIG. 1 taken along line 2-2.
Figure 3:
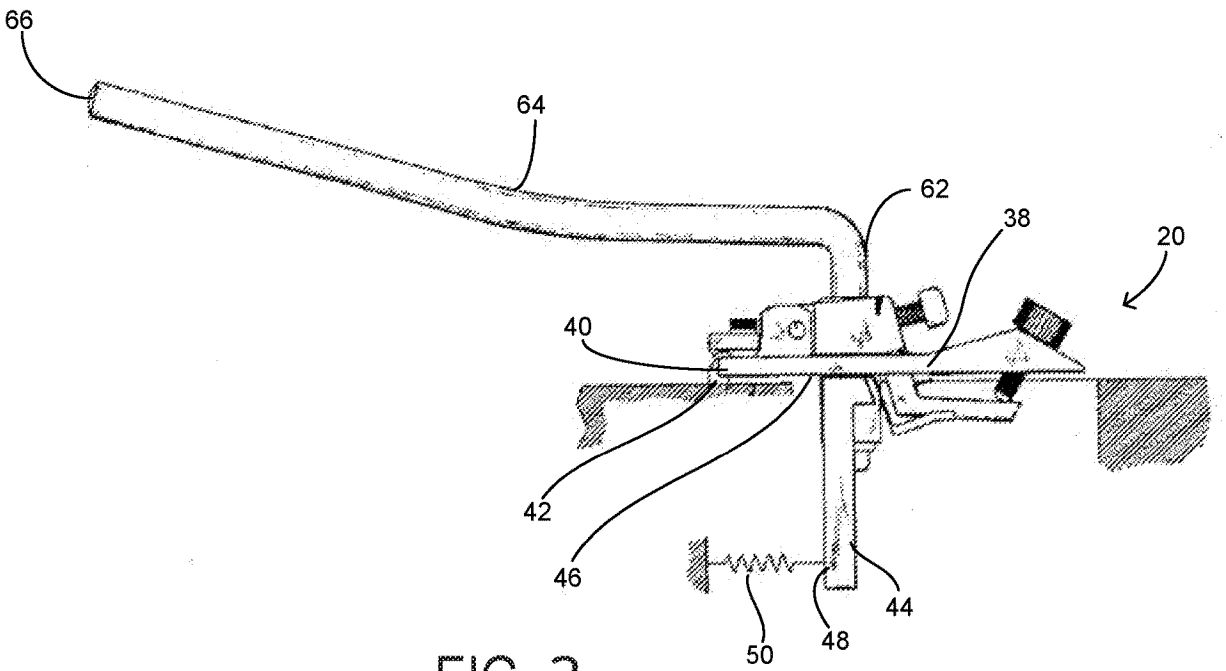
FIG. 3 PRIOR ART
FIG. 3 is a schematic illustration of the tremolo device of FIG. 2.

Referring now to FIGS. 2 and 3, for floating tremolos that are mounted within the body of a stringed musical instrument, such as guitar 10, a transverse slot 30 is formed in body 12 extending from the top surface 14 of the body through a bottom surface 32 of the body. Transverse slot 30 is in communication with recess 34, which extends adjacent the bottom surface of body 12 from the transverse slot toward the base of neck 16. Together, transverse slot 30 and recess 34 may be referred to as tremolo cavity 36.

Tremolo 20 includes a baseplate 38 which overlies transverse slot 30. Baseplate 38 is coupled to the top surface 14 of body 12, typically by screws positioned at a front end 40 of the baseplate to form a fulcrum 42, permitting limited pivotal movement of tremolo 20 about the fulcrum, and on and off of a baseplate float angle, as is further explained hereinafter.

A flange or solid tremolo block 44 is secured to an underside 46 of baseplate 38. Tremolo block 44 extends into transverse slot 30. Tremolo block 44 is provided with a plurality of apertures 48 configured to receive a spring 50 and couple the tremolo block to guitar body 12. More specifically, a first end of each one of the springs 50 is received within an aperture 48 of tremolo block 44 and an opposing end of the spring is attached to a tremolo claw or plate 52 which is, in turn, secured to front wall 54 defining a front end of recess 34 by tension adjustment screws 56.

Cover plate 58 closes tremolo cavity 36 and encloses access to the tremolo 20 from underneath the guitar. Cover plate 58 is typically secured to the underside of the guitar body 12 using a plurality of small screws.

Tremolo 20 further includes a whammy bar or tremolo arm assembly 60 that is provided on a lower lateral end of baseplate 38. Tremolo arm assembly 60 includes a vertical portion 62 extending upwards from baseplate 38, and a laterally directed portion 64, bent intermediate its ends, and terminating in a handle 66. In a normal playing position, handle 66 is positioned so as to be received by the palm of the guitarist's right hand when the guitarist is positioned to pick the strings.

When the guitarist desires to produce a tremolo effect, the guitarist presses his or her palm against the tremolo arm, or pulls the tremolo arm upwards away from the surface of the guitar, causing baseplate 38 to pivot about fulcrum 42 from a steady-state float angle, which, in turn, causes the underside 46 of tremolo block 44 to pivot toward and away from the rear end of body 12. This movement can cause springs 50 to stretch and compress as significant added and released tension is repeatedly applied to strings 26 as the float angle is moved back and forth during use of the tremolo system. After the guitarist releases tremolo bar 60, springs 50 return to their neutral position and cause tremolo block 44 to return to its vertical position, with the baseplate at a float angle. This returns the guitar to a desired tuning based on the tension on strings 26 when the floating tremolo is not being used to increase or decrease string tension.

For a variety of reasons, a guitarist or guitar technician may, nevertheless, need to adjust the bridge or baseplate float angle of the tremolo device 20. For example, the bridge float angle can change over time based on play, wear, change of string gauge, loss of tremolo spring tension, and other factors. In order to adjust a floating tremolo device, cover plate 58 must first be removed. After cover plate 58 has been removed, tension adjustment screws 56 may be rotated into front wall 54 to tension strings 26 or out of the front wall to release tension from the strings until the bridge float angle is positioned parallel to the top surface 14 of body 12. After the proper adjustments have been performed, cover plate 58 may be re-secured. This can be a time consuming process that requires a variety of tools as the screws used to secure cover plate 58 to guitar body 12 are often significantly smaller than tension adjustments screws 56. In addition, repeated adjustment of the screws can cause damage and enlargement of the screw holes in the body of the guitar and thereby require guitar body repair work. Further, a user must be careful to adjust the two or more screws by equal displacement so as not to change the tension on the springs that are being adjusted to adjust the float angle of the bridge.

The adjustment apparatus described hereinafter addressed these problems and provides an improved mechanism for adjusting the float angle of the tremolo for floating tremolos mounted within a guitar body where access to the tremolo springs for adjustment of the float angle is normally via the back cover plate of the guitar. More specifically, the adjustment apparatus in accordance with the present invention permits a user to adjust the bridge float angle of such a floating tremolo system using a single, simple tool and without the need to remove cover plate or adjust the spring tension directly.

Figure 4:
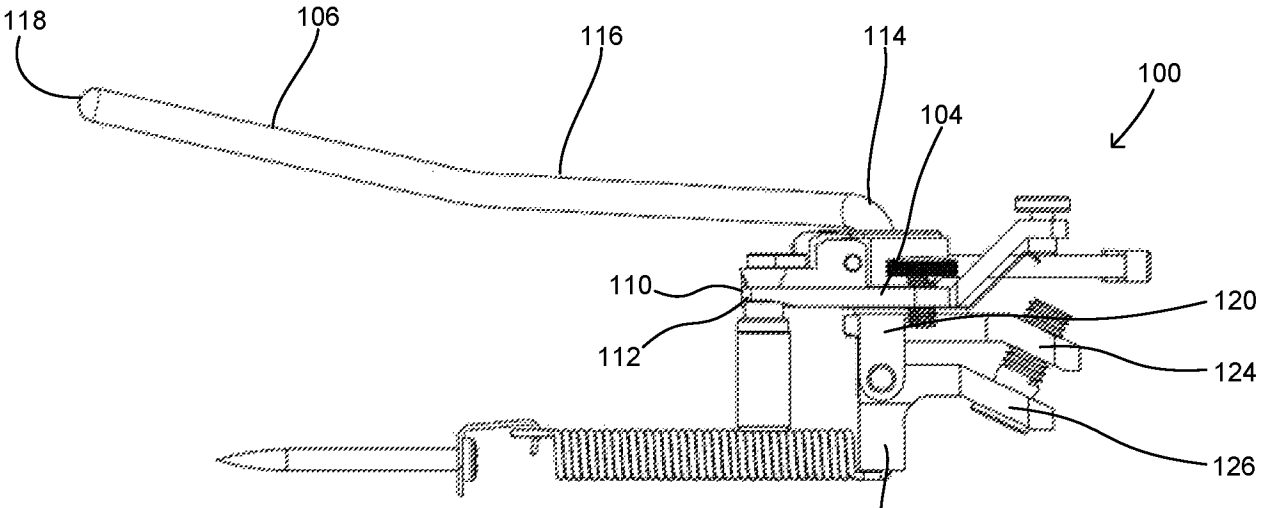
FIG. 4 is side plan view of a tremolo and adjustment apparatus according to an embodiment of the present disclosure.
Figure 5:
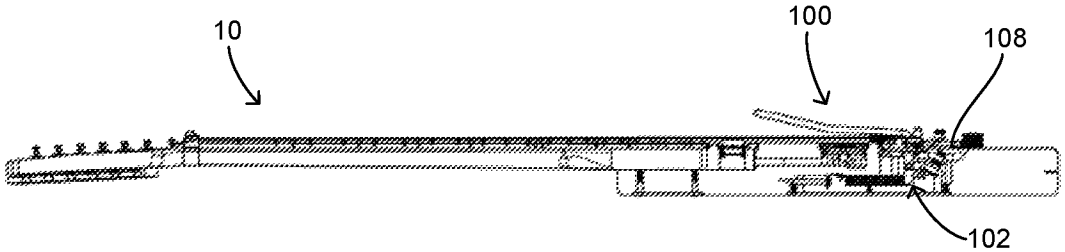
FIG. 5 is a cross-section view of an electric guitar coupled to the tremolo and adjustment apparatus of FIG. 4.

FIG. 4 illustrates an exemplary tremolo 100 including an adjustment apparatus 102. As is shown in FIG. 5, tremolo 100 is adapted to be coupled to guitar body 12 such that adjustment apparatus 102 is configured to be positioned primarily within tremolo cavity 36.

Tremolo 100 includes a baseplate 104 and a tremolo or whammy bar 106. Baseplate 104 preferably overlies only the front and middle portions of transverse slot 30 such that an access opening 108 is formed at the rear end of the transverse slot, providing some amount of limited access from the top of the guitar body to the tremolo cavity 36. Baseplate 104 is positioned generally parallel to the top surface 14 of guitar body 12, and is pivotable against the top surface of the guitar at one end, for example, by screws positioned at a front end 110 of the baseplate to form a fulcrum 112 permitting pivotal movement of tremolo 100 about the fulcrum at angles above and below the baseplate float angle, which is the neutral position of the baseplate when the whammy bar 106 is not being used.

Whammy bar 106 includes a vertical member 114 extending upwards from baseplate 104, and a laterally directed member 116, preferably bent intermediate its ends, and terminating in a handle 118. In a normal playing position, handle 118 is positioned so as to be received by the palm of the guitarist's right hand when the guitarist is positioned to pick strings 26.

In a preferred aspect of the present invention, adjustment apparatus 102 includes a two piece tremolo block assembly, including an upper block 120 integrally formed or otherwise attached to and extending from below the underside of baseplate 104, a lower block 122 pivotally connected to the upper block, and upper and lower tailpiece members 124, 126.

Figure 6:
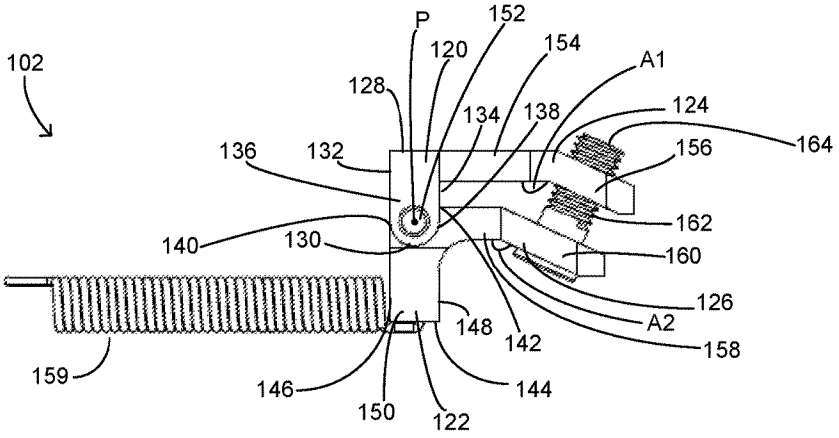
FIG. 6 is side plan view of the adjustment apparatus of FIG. 4.
Figure 7:
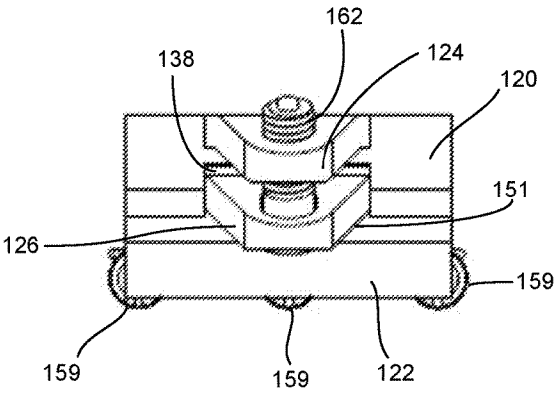
FIG. 7 is a rear plan view of the adjustment apparatus of FIG. 4.

Referring to FIGS. 6 and 7, upper block 120 includes a top surface 128, a bottom surface 130, a front surface 132, a rear surface 134, and opposing side surfaces 136. Bottom surface 130 may include a notch 138 extending toward baseplate 104 for receiving lower block 122. Notch 138 preferably is formed intermediate side surfaces 136 such that the side surfaces form a retaining flange 140 on either side of the notch. Upper tailpiece member 124 may be integrally formed or otherwise attached to and extend outwardly from upper block 120, for example, from rear surface 134 at a location above notch 138.

Lower block 122 includes a top surface 142, a bottom surface 144, a front surface 146, a rear surface 148, and opposing side surfaces 150. Lower block 122 may include an extension 151 having a width sized to be received by notch 138 such that the extension extends into the notch and is retained between retaining flanges 140. The bottom surface 144 of lower block 122 may include a plurality apertures 149 extending toward baseplate 104 or another mechanism configured to secure springs 151 for coupling the adjustment device 102 to guitar body 12. Lower tailpiece member 126 may be integrally formed or otherwise attached to and extend outwardly from lower block 122, for example, from the rear surface 148 of the lower block and, more specifically, from the portion of the lower block that is received by notch 138 such that lower tailpiece member 126 is disposed beneath and spaced apart from upper tailpiece member 124.

Upper block 120 is pivotally attached to lower block 122 via pivot pin 152 extending through the retaining flanges 140 of the upper block and the portion of the lower block that is received by notch 138. Accordingly, upper block 120 is permitted to pivot about lower block 122 and, more specifically, about pivot axis P extending along a longitudinal axis of pivot pin 152.

Upper tailpiece member 124 may include a laterally extending portion 154 and an angled portion 156. Laterally extending portion 154 may extend perpendicular to the rear surface 134 of upper block 120 and angled portion 156 may be angled downward such that the angled portion extends radially away from the rear surface of the upper block and toward the bottom surface 130 of the upper block, thereby forming an obtuse angle A1 between the laterally extending portion and the angled portion.

Lower tailpiece member 126 may include a laterally extending portion 158 and an angled portion 160. Laterally extending portion 158 may extend perpendicular to the rear surface 148 of lower block 122 and the angled portion may be angled downward such that the angled portion extends radially away from the rear surface of the lower block and toward the bottom surface 144 of the lower block, thereby forming an obtuse angle A2 between the laterally extending portion and the angled portion.

The angled portion 156 of upper tailpiece member 124 and the angled portion 160 of lower tailpiece member 126 may each include an aperture (not shown) through which an adjustment screw 160 extends. Adjustment screw 160 may, for example, be a hex screw and couple upper and lower tailpiece members 124, 126 to one another. A head 164, or adjustment tool receiving portion, may be positioned adjacent a top surface of the angled portion 156 of upper tailpiece member 124. Because upper and lower tailpiece members 124, 126 extend outwardly from upper and lower blocks 120, 122, respectively, and screw 162 extends between the angled portions 156, 160 of the upper and lower tailpiece members, the adjustment tool receiving portion of the screw is positioned beneath the access opening 108 of transverse slot 38. As a result, a user may access adjustment screw 162 through access opening 108 and make necessary adjustments to the bridge float angle without removing cover plate 58.

Rotation of the adjustment screw in a first direction R1, for example, a clockwise direction causes the upper and lower tailpiece members 124, 126 to move toward one another which, in turn, causes upper block 120 to rotate clockwise about pivot axis P. On the other hand, rotation of the adjustment screw in a second direction R2, for example, a counterclockwise direction causes the upper and lower tailpiece members 124, 126 to move away from one another which, in turn, causes upper block 120 to rotate in a counterclockwise direction about pivot axis P.

Because the baseplate 104 of tremolo 100 is attached to the top surface 128 of upper block 120, rotation of the upper block causes the baseplate to rotate about pivot axis P such that the tremolo pivots relative to the top surface 14 of guitar body 12 (i.e., the bridge float angle of the tremolo is adjusted). More specifically, when upper block 120 rotates clockwise about pivot axis P, the front end 110 of baseplate 104 pivots away from the top surface 14 of guitar body 12 and bridge 22, coupled to tremolo 100, moves toward the rear of the guitar body such that tension is applied to strings 26. On the other hand, when upper block 120 rotates counterclockwise about pivot axis P, the front end 110 of baseplate 104 pivots toward the top surface 14 of guitar body 12 and bridge 22, coupled to tremolo 100, moves toward the front end of the guitar body such that tension on strings 26 is reduced.

In an alternative embodiment (not illustrated), screw 162 may be inverted such that head 164, or adjustment tool receiving portion, is positioned adjacent a bottom surface of the angled portion 156 of lower tailpiece member 126. In this embodiment, an adjustment aperture sized and shaped for receiving an adjustment tool may be formed in cover plate 58, thus allowing a user to rotate screw 162 and adjust the bridge float angle also without removing the cover plate.

Figure 8:
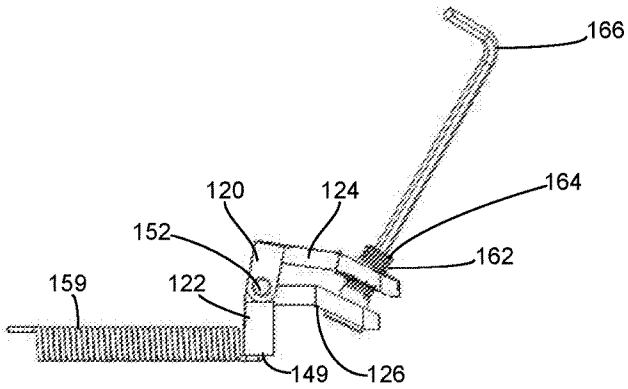
FIGS. 8 and 9 are side plan views of the adjustment apparatus of FIG. 6 during adjustment.
Figure 9:
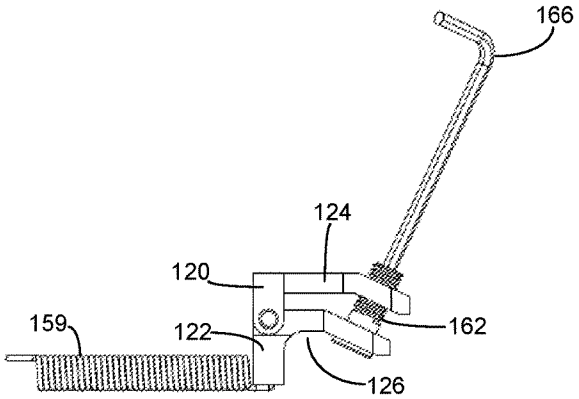

Use of adjustment device 102 will now be described. If the bridge float angle is, for example, toward the rear of the guitar, as shown in FIG. 8, a guitarist may insert an adjustment tool 166, such as a hex key, through access opening 108 and position the tool within the head 164 of screw 162. The user may then rotate the screw in a counterclockwise direction, causing upper and lower tailpiece members 124, 126 to move away from one another and upper block 120 to rotate about pivot axis P until the upper block is parallel to lower block 122 as shown in FIG. 9. In this position, the baseplate 104 of tremolo 100 will be parallel with the top surface 14 of guitar body 12. Alternatively, if the bridge float angle is, for example, toward the front of the guitar (not shown), a guitarist may position adjustment tool 166 within the head 164 of screw 162 and rotate the screw in a clockwise direction, causing upper and lower tailpiece members 124, 126 to move toward one another and upper block 120 to rotate clockwise about pivot axis P until the baseplate 104 of tremolo 100 is parallel with the top surface 14 of guitar body 12. Once the bridge float angle is properly positioned, strings 26 may be fine-tuned, or pitch tuned, as is known in the art.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A stringed musical instrument assembly comprising:
- a stringed musical instrument including an instrument body having a top surface and a bottom surface; and
- a floating tremolo coupled to the instrument body, the tremolo comprising:
  - a pivotable baseplate having a float angle relative to the top surface of the instrument body; and
  - a float angle adjustment apparatus comprising:
    - a first support block extending from an underside of the baseplate and at least partially into the instrument body below the top surface, the first support block having a first member extending outwardly from the first support block; and
    - a second support block pivotally connected to the first support block and coupled to the instrument body through a spring mechanism, the second support block having a second member extending outwardly from the second support block,
- wherein adjustment of a distance between the first member and the second member pivots the first support block about the second support block and, in turn, pivots the baseplate relative to the instrument body to adjust the float angle of the baseplate.

2. The assembly of claim 1, wherein the float angle adjustment apparatus further comprises an adjustable screw coupling the first member and the second member.

3. The assembly of claim 2, wherein the screw comprises a hex screw.

4. The assembly of claim 3, wherein a head of the hex screw is positioned adjacent a top surface of the first member.

5. The assembly of claim 3, further comprising a hex key for adjusting the hex screw.

6. The assembly of claim 2, wherein rotation of the screw in a first direction moves the first member toward the second member and rotation of the screw in a second direction opposite the first direction moves the first member away from the second member.

7. The assembly of claim 2, wherein a portion of the first member is angled in a downward direction relative to the top surface of the instrument body and a portion of the second member is angled in a downward direction relative to the top surface of the instrument body.

8. The assembly of claim 7, wherein the angled portion of the first member is substantially parallel with the angled portion of the second member when the float angle of the baseplate is parallel to the top surface of the instrument body.

9. The assembly of claim 7, wherein the screw is coupled between the angled portion of the first member and the angled portion of the second member such that the screw is accessible through an opening in the top surface of the instrument body.

10. The assembly of claim 1, wherein the stringed musical instrument is a guitar.

11. A floating tremolo apparatus comprising:

a baseplate; and a float angle adjustment apparatus connected to the baseplate for adjusting a float angle of the baseplate relative to a surface of a stringed musical instrument, the adjustment apparatus comprising:

a first support block extending from an underside of the baseplate, the first support block having a first member extending outwardly from the first support block;

a second support block pivotally connected to the first support block, the second support block having a second member extending outwardly from the second support block; and an adjustable screw coupling the first member and the second member, wherein rotation of the screw causes the first member to move relative to the second member and pivot the first support block about the second support block and, in turn, pivot the baseplate to adjust the float angle of the baseplate.

12. The assembly of claim 11, wherein the screw is comprises a hex screw.

13. The floating tremolo apparatus of claim 11, wherein rotation of the screw in a first direction moves the first member toward the second member and rotation of the screw in a second direction opposite the first direction moves the first member away from the second member.

14. A float angle adjustment apparatus for a floating tremolo comprising:

a lower block attachable by a spring mechanism to a body of a stringed musical instrument, the lower block including top, bottom, front, side, and rear surfaces, and a lower tailpiece extending rearwardly from the lower block;

an upper block pivotally connected to the lower block and including top, bottom, front, side, and rear surfaces, and an upper tailpiece extending rearwardly from the upper block, the upper tailpiece being spaced apart from the lower tailpiece; and an adjustable screw coupling the lower tailpiece to the upper tailpiece such that rotation of the screw causes the top surface of the upper block to pivot relative to the top surface of the lower block.

15. The float angle adjustment apparatus of claim 14, wherein the screw comprises a set screw such that rotation of the set screw in a first direction moves the upper and lower tailpieces towards one another and rotation of the set screw in a second direction opposite the first direction moves the upper and lower tailpieces away from one another.

16. The float angle adjustment apparatus of claim 14, wherein a portion of the upper tailpiece is angled in a downward direction relative to the top surface of the upper block and a portion of the lower tailpiece is angled in the downward direction relative to the top surface of the upper block.

17. The float angle adjustment apparatus of claim 16, wherein the set screw extends between the downwardly angled portions of the upper and lower tailpieces.

18. The float angle adjustment apparatus of claim 17, wherein a head of the set screw is positioned adjacent a top surface of the upper tailpiece.

19. The float angle adjustment apparatus of claim 14, wherein the upper block includes a notch for receiving a portion of the lower block and the apparatus further comprises a pivot pin extending through the upper block and the portion of the lower block received by the upper block.

20. The float angle adjustment apparatus of claim 14, wherein the lower block includes one or more apertures configured to receive one or more springs for coupling the lower block to a musical stringed instrument.

* * * * *